US006676062B1

(12) United States Patent
Herhaus

(10) Patent No.: US 6,676,062 B1
(45) Date of Patent: Jan. 13, 2004

(54) DEVICE FOR DISCHARGING WEBS

(75) Inventor: Jürgen Herhaus, Radervormwald (DE)

(73) Assignee: Honigmann Industrielle Elektronik GmbH, Wuppertal (DE)

( * ) Notice: Subject to any disclaimer, the term of this patent is extended or adjusted under 35 U.S.C. 154(b) by 0 days.

(21) Appl. No.: 09/744,854

(22) PCT Filed: Jun. 2, 2000

(86) PCT No.: PCT/EP00/05063

§ 371 (c)(1),
(2), (4) Date: Mar. 27, 2001

(87) PCT Pub. No.: WO00/73185

PCT Pub. Date: Dec. 7, 2000

(30) Foreign Application Priority Data

Jun. 1, 1999 (DE) ..... 199 25 108

(51) Int. Cl.[7] ..... B65H 19/14; B65H 19/18; B65H 19/20

(52) U.S. Cl. ..... 242/417; 242/420.6; 242/552; 156/504

(58) Field of Search ..... 242/420.6, 421.7, 242/552, 417, 417.2, 417.3; 156/504, 157, 159

(56) References Cited

U.S. PATENT DOCUMENTS 3,822,838 A * 7/1974 Butler et al. ..... 242/552
3,836,089 A * 9/1974 Riermersma ..... 242/552
4,065,067 A * 12/1977 Martinez ..... 242/552
4,497,454 A * 2/1985 Woodley ..... 156/159
5,190,234 A 3/1993 Ezekiel
5,223,069 A 6/1993 Tokuno et al. ..... 156/351
5,518,202 A * 5/1996 Focke et al. ..... 242/552
6,340,130 B2 * 1/2002 Wild et al. ..... 242/420.6

FOREIGN PATENT DOCUMENTS

| | | |
|---|---|---|
| DE | 7501986 | 9/1975 |
| DE | 3504669 | 2/1985 |
| EP | 0169476 | 7/1985 |

* cited by examiner

*Primary Examiner*—John M. Jillions
(74) *Attorney, Agent, or Firm*—Pandiscio & Pandiscio

(57) ABSTRACT

The present invention concerns a device for discharging webs at a predetermined web speed in an uninterrupted process, in which the web end (37) on an initially active take-off roll (2) must be placed against and joined to the beginning of a web on a roll initially situated in a waiting station. To this end, the web tension in the processing line (39) is adjusted to a predetermined target value. In order to influence the web tension in additional areas during the joining of the web ends (37), a web accumulator equipped with an externally controlled drive is provided in addition to the compensation system.

42 Claims, 1 Drawing Sheet

M
M
1
2
3
4
5
6
7
8
9
10
11
12
13
14
15
16
17
18
19
20
21
22
23a
23b
24
25
26
27
28
29
30
31
32
33
34
35
36
37
38
39
40
41
42
43
44
45
46
47
48

DEVICE FOR DISCHARGING WEBS

The present invention concerns a device for discharging webs.

Such a device, as used specifically in connection with a splicing station where web ends are assembled, is known from DE GM 86 15 787. However, this should not be taken as a restriction of the invention to such applications. Since such webs must be handled primarily in uninterrupted processes, such devices include, in addition to an active take-off roll, yet another roll in a waiting station. Once the active take-off roll reaches the end of the wound-up web, the leading end of the roll still in the waiting station must be attached to the end of the web that has just been unwound. This function is performed by a splicing station where the two web ends are joined, by means of adhesive tape, for example. The process can then be resumed, it being understood that the roll that was originally in the waiting station must now be considered the active take-off roll, whereas a fresh roll is transferred to the waiting station.

To keep the web tension of the discharged web within set limits, i.e., to keep it as constant as possible, a compensation system is provided that measures the current web tension. The deflection of the compensation system can be used to generate a closed-loop control signal by means of which the take-off speed is adjusted to produce the desired web tension.

So that splicing can be performed during uninterrupted operation, according to DE-OS 24 24 302 a web accumulator is provided, in which the web passes over two stationary rolls and a gravity-type roll located between them. The gravity-type roll is movably guided in a longitudinal guide transversely to the line connecting the stationary rolls, and can pay out the temporarily stored web material inside this longitudinal guide as soon as it is required by the downstream processing areas.

An essential problem here is to keep the movable roll operating freely. To this end, seals must be provided on the longitudinal guide to protect it from undesirable contamination. However, these seals create additional friction, in addition to which it must be kept in mind that many of the web materials for processing contain carbon black or the like. This promotes contamination of the longitudinal guide. Especially in the case of traction-sensitive webs, such as those that are the respective subjects matter of DE-PS 195 12 963 and DE-GM 85 15 787, every effort must be made to prevent bunching at the longitudinal guide of the web accumulator.

It is, therefore, an object of the present invention to improve the known device for discharging webs in such a way that especially sensitive webs can continue to run unaffected by mass-dynamic effects, even when the process is being interrupted for operational reasons. In the application of the invention to a web discharging device accompanied by a splicing station, during splicing the web must continue to pass through the processing line under a practically unchanged discharging force even when the web end that has just been discharged is being attached to the leading end of the fresh web.

The invention allows of all embodiments in which the web present in the web accumulator is paid out into the processing line or is fed as needed from the processing line back into the web accumulator for further storage.

In its specific use in conjunction with a splicing station, the invention allows of all embodiments in which the end of the web that has just been discharged confronts the beginning of the newly added web, irrespective of whether the web ends are assembled at the same speed, at a lower speed, or at a speed of 0.

Of practical importance, however, is an embodiment in which the web ends remain stationary for such time as they are being assembled. The capacity of the web accumulator is advantageously tailored to this type of application. Such an application calls for the largest storage capacity, in practice, and should have the simplest construction in order to facilitate the practical implementation of the device according to the invention.

The invention furnishes the advantage that the web accumulator, in order to pay out the web stored therein, is imparted a speed that is set by the open-loop control signal for the controllable drive.

The web pay-out speed can therefore be preset not only over a broad range, but also, by closed-loop control, within a very narrow set of limit values.

This advantage is achieved by the fact that the web accumulator is imparted a web pay-out speed that is so high that when splicing is being performed, the arresting of the web ends that occurs upstream of the web accumulator can go "unnoticed" in the processing line downstream of the web accumulator, or, to put it another way, in stop-and-go mode there is always an adequate stored length available to permit vigorous take-off motions at web travel speeds of 60 n/min or more with sharp acceleration and braking gradients, even in the case of traction-sensitive web materials.

Thus, through adjustment of the assigned process parameters and manipulated variables, the entire process can be controlled in a practically transitionless manner during stop-and-go operation or in making the changeover between two web take-off rolls. The forced control of the web accumulator, especially its rate of acceleration as it is being started from neutral position, can be imposed within further limits by means of motors. Thus, even in the case of highly sensitive adhesive tapes made of traction-sensitive materials, the elastic deformability of the material is utilized as needed, during splicing, for example.

Plastic destruction of the web materials can be reliably prevented by the selection of suitable drives with high starting torques/starting accelerations.

The web accumulator can thus be used, for example, for the temporary storage of a length of web equal to the amount consumed, when splicing is taking place, during the periods of stoppage of the web ends in the downstream processing line.

In the case of stop-and-go operation, the dynamic components of demand in the processing line are controlled on a closed-loop basis via the compensation system, which constitutes a position feedback transmitter, and are serviced from the web accumulator within the scope of this closed-loop control.

The web accumulator can also operate bidirectionally, provided that it has enough room for reverse accumulation.

In the case of stop-and-go operation, the active take-off roll replenishes the web accumulator. Provided for this purpose is a closed-loop control system that can be implemented as a simple on-off control system (=two-point control), a three-point control system, or a continuous control system.

Depending on the type of control system selected, the refilling of the accumulator then takes place either in a pumping motion, as in the case of two-point control, for example, or in position-controlled fashion based on the current position of the accumulator, as with continuous control.

In the case of three-point control, the filling of the accumulator proceeds at a preset accumulation speed until the end position, "Shut Off," is reached.

The preferred solution is position control combined with the "Shut Off" end position, in which case continuous control of the delivery speeds of the active take-off roll is performed within a relatively short end-of-travel region before attainment of the "Shut Off" end position. This method advantageously eliminates the pumping effect that is evident in the case of a two-point control system.

To this end, the movable accumulator roll must be provided with an electronic position interrogator by means of which the position signal is stored in the appropriate control circuit.

When the invention is used in combination with a splicing station, after the web ends have been spliced the controllable drive of the web accumulator, which has been acting in the downstream direction to pay out the web, is either switched off or put in reverse so that the web accumulator can begin filling again to be ready for the next splicing operation.

The open-loop control signal for the web accumulator drive can be a simple on/off signal. The drive is set in motion by the "on" signal and remains in this state until the "off" signal follows. Alternatively, the open-loop control signal can represent the predetermined target value. In this way, when splicing is being performed, the web tension in the downstream processing line can be kept at least within the order of magnitude of the predetermined target value.

Still more exact adherence to the predetermined target value is achieved by means of a reference signal derived from the output signal of the compensation system and the predetermined target value. In this fashion, during splicing the web tension in the processing line can also be adjusted to a value slightly above the predetermined target value. This measure reliably eliminates the risk of formation of folds, since there is no possibility of local slackness in the discharged web.

It is nevertheless essential for this improvement of the invention that, in any case, the web accumulator drive be incorporated into a closed control loop in which the current web tension is measured downstream of the splicing station and is adjusted to a preset value.

The output signal from the compensation system is especially well suited to this purpose, since it is already being adjusted to a value within the order of magnitude of the predetermined target value that prevails during the discharge of the web from the active take-off roll. Especially in the case of traction-sensitive long goods, it is also expedient to use the output signal from the compensation system during regular operation to control a roll drive motor, since such take-off rolls are naturally very heavy and their inertia is therefore high. Thus, causing the active take-off roll to be acted upon by a controlled roll drive motor as a function of the web tension reliably prevents plastic material deformation caused by rapid changes in take-off speed.

This improvement of the invention merits particular attention, therefore, since the output signal from the compensation system can also be used to control the web accumulator drive during splicing. When splicing is to be done, the end of the leading web is reached. The take-off roll concerned no longer needs a controlled drive. Nevertheless, the compensation system adjusts the take-off tension to the predetermined target value, while at the same time, the need arises for the temporarily stored web to be fed into the processing line. Now the output signal from the compensation system can therefore be used to control the web accumulator drive, while the compensation system is simultaneously kept to its predetermined nominal position, thereby maintaining conformity with the predetermined target value.

In this case, therefore, the speed at which web is being paid out of the accumulator must be adjusted in a way that preserves the position of the compensation system.

This purpose is served by the output signal from the compensation system, which naturally changes whenever the compensation system deviates from the prescribed position.

This change in position is ultimately transformed into a corrective signal for the web accumulator drive, by means of which the compensation system is brought back into its nominal position.

The compensation system thus uses its own output signal to control its predetermined nominal position so as to maintain an at least substantially constant tensile load in the downstream portion of the processing line, even during splicing. Normal processing operation then resumes smoothly. In addition, by mere commutation, the output signal from the compensation system can be used to control the web tension both in regular processing mode and during splicing.

If the compensation system is desired to be used as the sole closed-loop control system during normal processing operation, one option is to leave the web accumulator idling in a defined end position during normal processing operation. In this case, fluctuations in web tension are detected only by the compensation system. Such fluctuations do not result in any change in the position of the web accumulator.

In addition to the drives for the splicing station, the drive for the web accumulator must also be able to react very quickly and, in particular, to furnish high rates of acceleration. Electrical or pneumatic drives are therefore candidates for this function. The use of hydraulic drives is also conceivable, although they do entail problems with regard to environmental pollution.

Advantageous improvements of the invention will emerge from the dependent claims.

The invention is described in more detail hereinbelow with reference to an exemplary embodiment. In the drawing.

Figures 1, 2:
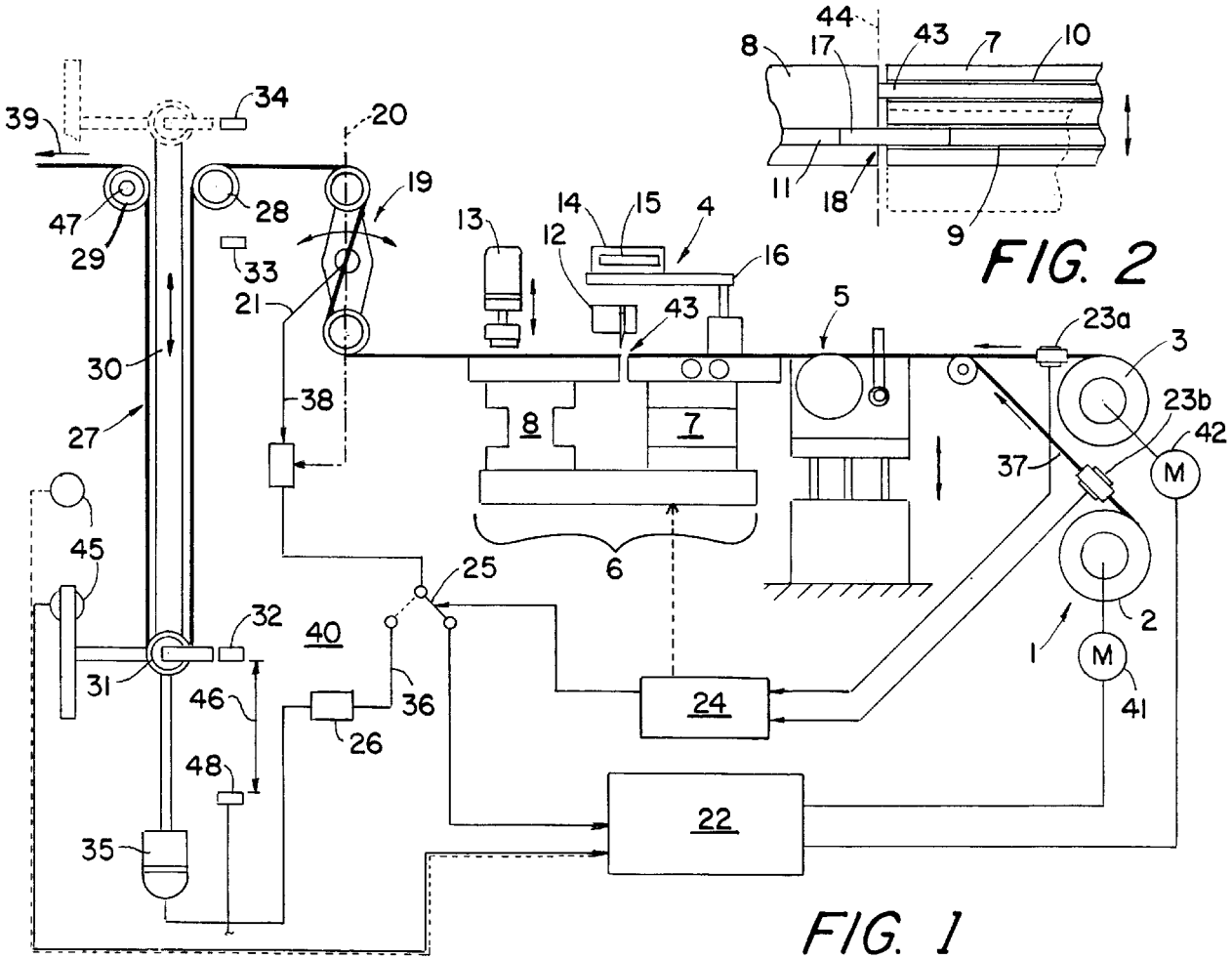
FIG. 1 represents a first exemplary embodiment of the invention.
FIG. 2 is a detailed view in plan of a splicing station in accordance with FIG. 1.

The figures show a device for discharging webs at a predetermined web speed in an uninterrupted process, including a stop-and-go mode. Provided for this purpose is a delivery system 1 comprising, in addition to an active take-off roll 2, an additional roll 3 in a waiting station. This web delivery unit therefore consists of two take-off rolls that are in principle of identical construction, and one of which is in running mode while the other is in a waiting position. Disposed downstream of the delivery system 1 are—without restricting the invention hereto—a splicing station 4, where the end 37 of the web from the active take-off roll 2 is placed against and joined to the beginning 43 of the web from roll 3 of the waiting station. This splicing station 4 comprises a preceding elevator 5 and a subsequent bonding station 6. The preceding elevator 5 serves the purpose of allowing the web to pass through the splicing station 4 without contact during normal processing operation. It consists essentially of a deflecting roller that can be conveyed into the path of the web, so that a web passing over it is raised above the splicing station 4.

The bonding station 6 is in principle of two-part construction and consists of a rolling table 7 and a downstream fixed table 8.

As FIG. 2 shows, the rolling table comprises an active guide groove 9 and, disposed parallel thereto, a waiting-position guide groove 10.

The fixed table has only one take-off groove 11. It is essential that the rolling table be orientable so that its active guide groove 9 can be aligned exactly with the take-off groove 11 of the fixed table.

The rolling table 7 can be moved by a suitable drive in the direction of the arrow shown in FIG. 1 and the double arrow of FIG. 2 in such a way that in one of its positions, its active guide groove 9 is exactly aligned with take-off groove 11, and in the other ones of its positions, guide groove 10 is exactly aligned with take-off groove 11.

Disposed between rolling table 7 and fixed table 8 is a cutter 12, which can, for example, include a rotatably mounted knife.

Also provided, for temporary stopping, is a stopper 13 that holds the web being conveyed into the processing line 39 on the fixed table 8 of splicing station 4 during the splicing procedure.

The cutter 12 severs the end 37 of the active take-off roll 2 at the cutting edge 44, so that the beginning 43 of the web from the waiting station can be abutted with it by the translation of rolling table 7 into the splicing position shown in phantom lines. The joint abutment 18 between the two web ends therefore lies on the cutting line 44, which is determined by the position of the cutter 12. The two ends are joined by means of an adhesive-tape holder 14 swivelable about a swivel axis 16. The adhesive-tape holder 14 is provided with air intake openings 15 for temporarily securing a piece of adhesive tape 17, shown in crosshatching in FIG. 2.

Swiveling the adhesive-tape holder 15 about swivel axis 16 enables the prepared adhesive tape to be applied to both web ends from above and affixed thereto.

The above-described splicing station is optional and can advantageously be integrated into the invention.

Provided downstream of the splicing station 4 is a compensation system 19, whose output signal 38 is used to adjust the tension of the discharged web in the processing line 39 to a predetermined target value. For this purpose, the compensation system 19 assumes a nominal position 20 that is preferably roughly central to the range of motion of said compensation system 19. In this way, the compensation system can swivel out of the nominal position 20 to a roughly equal distance on both sides. The compensation system 19 is preloaded with a set torque, which is kept in balance by means of the web passing over it. Deviations from the nominal position 20 are picked up by a position detector 21 and transformed via a closed control loop 22 into a corresponding control signal for each of the roll drive motors 41 and 42. Such a closed-loop control system is the subject matter of DE-PS 195 12 963, for example. The details will not be described further here, but reference is made to the entire disclosure content of that document, where they are given in full. However, it should be made clear that such closed-loop control of the web tension in the processing line is not a fundamental requirement for the present invention. Rather, the present invention can also be used with take-off systems that are not equipped with web take-off control devices in accordance with DE-PS 195 12 963.

It is essential, however, that arranged downstream of compensation system 19 is a web accumulator 27 that is filled (32) during normal processing operation, and that in cases where splicing is performed, the web accumulator 27 is provided with an externally controllable drive 35 for stop-and-go mode that pays out the stored web from the web accumulator 27 into the processing line 39. To this end, provided in the infeed areas between the delivery system 1 and the splicing device 4 are web sensors 23*a* and 23*b*, each of which transmits a signal as needed to the transducer 24 as soon as the end of a web has been detected.

In a specific exemplary embodiment, the output signal from the transducer 24 is delivered to the changeover switch 25.

Supplementarily, it is provided in this case that the drive 35 of web accumulator 27 is acted upon by a control signal 36 that represents the predetermined target value 20. This purpose is served by the changeover switch 25, which is acted upon by the output signal from the transducer 24, so that output signal 38, which always represents the actual value of the current web tension, is delivered to the controllable drive 35 of web accumulator 27.

Such a web accumulator consists of two stationary rolls, specifically a stationary input roll 28 and a stationary output roll 29, arranged one after the other in the path of the web. Provided between these two rolls is an accumulator roll 31 drivable to move transversely thereto and guided in a longitudinal guide 30. The position, speed and rate of acceleration of the movable accumulator roll 39 are determined in each case by the controllable drive 35.

Also illustrated is a sensor pair 45 that is activated by the movable accumulator roll 31 before the full position 32 is reached.

The output signal from this sensor pair 45 corresponds to a three-point control system and transmits a "Full" signal, representing the content of the accumulator at that time, to the roll drive motor 41 for active take-off roll 2.

Supplementarily hereto, in place of a sensor pair 45, an analog sensor can be used to effect continuous closed-loop control.

In addition, FIG. 1 shows that the open-loop control signal delivered to the controllable drive 35 via open-loop control-signal line 36 is the output signal of a closed control loop 40, by means of which the web tension downstream of the splicing station 4 is measured and adjusted to a predetermined value (20).

A particularity here is that from the output signal 38 of accumulator system 19 and predetermined target value 20 there is generated a reference signal that serves to control drive 35 via closed-loop control-signal line 36. Supplementarily, a function network 26 can be provided, by means of which the reference signal temporarily increases the current web tension slightly above the predetermined target value 20. This measure can be used reliably to prevent the formation of folds in sensitive adhesive tapes.

Taken as a whole, the invention results in the creation of an additional closed control loop 40 that is preferably put into operation when closed control loop 22 is switched off. In this situation, output signal 38 from accumulator system 19 is used during the discharging of the web from active take-off roll 2 to control an assigned roll drive motor 41, and for splicing is switched over to the control of drive 35 of web accumulator 27. Supplementarily provided in the present case are three position sensors that monitor the position of accumulator roll 31. In the full position 32, accumulator roll 31 is in its most extended position. If the accumulator is emptied, accumulator roll 31 moves toward stationary rolls 28, 29. In the meantime, an empty-position sensor 33 monitors the end of the accumulated segment so that the next apparatus can also be shut down if necessary.

If accumulator roll 31 moves past stationary rolls 28, 29, the loading position 34 is reached, in which the web can be loaded before the apparatus is started.

In this connection, the sensor serves in particular to monitor the full position 32 in order to recognize that web accumulator roll 31 is in idle position, since it should stand idle in its defined end position (32) during normal processing operation.

In addition to the full position 32, the web accumulator 27 shown also offers the possibility of reverse accumulation of web from the processing line 39. A range of motion 46 situated past the full position 32 is provided for this purpose.

Although this is not intended to signify a restriction of the invention to the overall system shown, the web delivery unit 1, the splicing station 4 and the compensation system 19 are stationary in this case. For this application, the storage capacity of the web accumulator must be at least equal to the product of the predetermined web speed and the time needed to splice web ends 37+43.

Supplementarily hereto, FIG. 1 shows the alternative arrangement of the compensation system 19 downstream of the web accumulator 27. As long as there is a frictional connection between the web-accumulator input and the compensation-system output or vice-versa, the relative arrangement of the web accumulator and the compensation system does not matter. The electrical wiring and electronic circuitry of this alternative embodiment corresponds to the wiring and circuitry shown.

Supplementarily hereto, the stationary output roll 29 of web accumulator 27 includes a tensile-load-measuring device 47 by means of which the current tensile load can be measured immediately ahead of the processing line 39.

Direct measurement of the current tensile load before the web is fed into the processing line can be used for purposes of quality assurance, monitoring, documentation. By the same token, a closed-loop control signal can be obtained by this means for the downstream portion of the process, if there is a need for such control in that area.

Should the range of motion 46 for reverse accumulation be exceeded, an Emergency Off sensor 48 is provided to promptly shut down the affected portions of the system.

What is claimed is:

1. A device for discharging webs at a predetermined web speed, the device comprising a web delivery unit (1) at which an active take-off roll (2) is provided, and comprising a compensation system (19) whose output signal (38) is used to adjust tension of a discharged web in a processing line (39) to a predetermined target value (20), wherein arranged in series with said compensation system (19) is a web accumulator (27) that is filled during normal processing operation, and wherein said web accumulator (27) is provided, for stop-and-go operation, with an externally controllable drive (35) that pays out a stored web from said web accumulator (27) into said processing line (39), wherein said drive (35) of said web accumulator is acted upon by a control signal (36) that represents said predetermined target value (20), wherein said control signal (36) is an output signal of a closed control loop (40) by means of which the web tension in, or in advance of, the processing line is measured and adjusted to a predetermined value, wherein from the output signal of said compensation system (19) and said predetermined target value (20) there is generated a reference signal that serves as a manipulated variable for controlling said drive (35), and wherein said reference signal temporarily increases a reference tension to a value slightly above said predetermined target value (20).

2. The device in accordance with claim 1 wherein said output signal (38) from said compensation system (19) is used during the discharging of the web from said active take-off roll (2) to control a roll drive motor (41), and for splicing is switched over to the control of said drive (35) of said web accumulator (27).

3. The device in accordance with claim 1 wherein said output signal (38) from said compensation system (19) is used during the discharging of the web through said processing line (39) to control said drive (35) of said web accumulator (27).

4. The device in accordance with claim 1 wherein during normal processing operation said web accumulator (27) serves to adjust differences between the speed of said processing line (39) and the infeed speed of said active take-off roll (2).

5. The device in accordance with claim 1 wherein said web accumulator (27) comprises two deflecting rolls (28, 29) arranged one after the other in a web path, between which is disposed an accumulator roll (31) drivable to move transversely to them and operated by said controllable drive (35) to move toward said stationary deflecting rolls (28, 29) and back.

6. The device in accordance with claim 1, wherein said web accumulator (27) is driven by a selected one of electrical and hydraulic and pneumatic means.

7. The device in accordance with claim 1, wherein in addition to said active take-off roll (2), a further roll is provided in a waiting station (3) and, downstream of said web delivery unit (1), a splicing station (4) where an end (37) of the web of said active take-off roll (2) is placed against a beginning of said roll in said waiting station and is joined thereto, and wherein when splicing is being performed, said web accumulator pays out the stored web into said processing line.

8. The device in accordance with claim 1 wherein during normal operation said web passes without contact through a splicing station (4) disposed in advance of said web accumulator.

9. The device in accordance with claim 1, wherein said web delivery unit (1), a splicing station (4) and a compensation system (19) disposed in advance of said web accumulator are stationary and in that the storage capacity of said web accumulator (27) is at least equal to the product of the predetermined web speed and the time needed, in the case concerned, to splice the web ends (37 and 43).

10. The device in accordance with claim 8, wherein during normal processing operation, said web accumulator stands idle in a defined end position (32).

11. The device in accordance with claim 5, wherein provided in the web path between said web accumulator (27) and said processing line (39) is a device for measuring current tensile load (47).

12. The device in accordance with claim 5, wherein end positions of the movable roll (31) of said web accumulator (27) are analyzed electronically with respect to the current position thereof.

13. The device in accordance with claim 1 and further comprising a cutter (12) for severing an end (37) of the active take-off roll (2) at a cutting edge (44), such that a beginning (43) of a web from a waiting station can be abutted with the end (37) by translation of a rolling table (7) into a splicing position.

14. The device in accordance with claim 13 wherein operation of a stopper (13) and the abutting of the web ends (37, 43) in a splicing station (4), in cooperation with the controllable drive (35) of the web accumulator (27) serve to provide precision splicing of webs.

15. The device in accordance with claim 1 wherein said drive (35) of said web accumulator is acted upon by a control signal (36) that represents said predetermined target value (20).

16. The device in accordance with claim 15, wherein said control signal (36) is an output signal of the closed control loop (40) by means of which the web tension in, or in advance of, the processing line is measured and adjusted to a predetermined value.

17. The device in accordance with claim 16, wherein from the output signal of said compensation system and said predetermined target value (20) there is generated a reference signal that serves as a manipulated variable for controlling said drive (35).

18. The device in accordance with claim 17, wherein said output signal (38) from said compensation system (19) is used during the discharging of the web from said active take-off roll (2) to control a roll drive motor (41), and for splicing is switched over to the control of said drive (35) of said web accumulator.

19. The device in accordance with claim 17, wherein said output signal (38) from said compensation system (19) is used during the discharging of the web through said processing line (39) to control said drive (35) of said web accumulator (27).

20. The device in accordance with claim 1, wherein during normal processing operation said web accumulator (27) serves to adjust differences between the speed of said processing line (39) and the infeed speed of said active take-off roll (2).

21. The device in accordance with claim 1, wherein said web accumulator (27) comprises two deflecting rolls (28, 29) arranged one after the other in a web path, between which is disposed an accumulator roll (31) drivable to move transversely to them and operated by said controllable drive (35) to move toward said stationary deflecting rolls (28, 29) and back.

22. The device in accordance with claim 1, wherein said web accumulator (27) is driven by a selected one of electrical and hydraulic and pneumatic means.

23. The device in accordance with claim 1, wherein in addition to said active take-off roll (2), a further roll is provided in a waiting station (3) and, downsteam of said web delivery unit (1), a splicing station (4) where an end (37) of the web of said active take-off roll (2) is placed against a beginning (43) of said roll in said waiting station and is joined thereto, and wherein when splicing is being performed, said web accumulator pays out the stored web into said processing line.

24. The device in accordance with claim 1, wherein during normal operation said web passes without contact through a splicing station (4) disposed in advance of said web accumulator.

25. The device in accordance with claim 23, wherein said web delivery unit (1), a splicing station (4) and the compensation system (19) disposed in advance of said web accumulator are stationary and in that the storage capacity of said web accumulator (27) is at least equal to the product of the predetermined web speed and the time needed, in the case concerned, to splice the web ends (37 and 43).

26. The device in accordance with claim 24, wherein during normal processing operation, said web accumulator stands idle in a defined end position (32).

27. The device in accordance with claim 21, wherein provided in the web path between said web accumulator (27) and said processing line (39) is a device for measuring current tensile load (47).

28. The device in accordance with claim 21, wherein end positions of the movable roll (31) of said web accumulator (27) are analyzed electronically with respect to the current position thereof.

29. A device for discharging webs at a predetermined web speed, the device comprising a web delivery unit (1) at which an active take-off roll (2) is provided, and comprising a compensation system (19) whose output signal (38) is used to adjust tension of a discharged web in a processing line (39) to a predetermined target value (20), wherein arranged in series with said compensation system (19) is a web accumulator (27) that is filled during normal processing operation, and wherein said web accumulator (27) is provided, for stop-and-go operation, with an externally controllable drive (35) that pays out a stored web from said web accumulator (27) into said processing line (39), the device further comprising a stopper (13) which holds the web being conveyed into the processing line (39) on a fixed table (8) of a splicing station (4) during a splicing procedure, wherein said drive (35) of said web accumulator (27) is acted upon by a control signal (36) that represents said predetermined target value (20), said control signal (36) is an output signal of a closed control loop (40) by means of which the web tension in, or in advance of, the processing line is measured and adjusted to a predetermined value, wherein from the output signal of said compensation system and said predetermined target value (20) there is generated a reference signal that serves as a manipulated variable for controlling said drive (35), and said reference signal temporarily increases a reference tension to a value slightly above said predetermined target value (20).

30. The device in accordance with claim 29 and further comprising a cutter (12) for severing an end (37) of the active take-off roll (2) at a cutting edge (44), such that a beginning (43) of a web from a waiting station can be abutted with the end (37) by translation of a rolling table (7) into a splicing position.

31. The device in accordance with claim 30 wherein operation of stopper (13) and the abutting of the web ends (37, 43) in the splicing station (4), in cooperation with the controllable drive (35) of the web accumulator (27) serve to provide precision splicing of webs.

32. The device in accordance with claim 29, wherein said output signal (38) from said compensation system (19) is used during the discharging of the web from said active take-off roll (2) to control a roll drive motor (41), and for splicing is switched over to the control of said drive (35) of said web accumulator.

33. The device in accordance with claim 29, wherein said output signal (38) from said compensation system (19) is used during the discharging of the web through said processing line (39) to control said drive (35) of said web accumulator (27).

34. The device in accordance with claim 29, wherein during normal processing operation said web accumulator (27) serves to adjust differences between the speed of said processing line (39) and the infeed speed of said active take-off roll (2).

35. The device in accordance with claim 29, wherein said web accumulator (27) comprises two deflecting rolls (28, 29) arranged one after the other in a web path, between which is disposed an accumulator roll (31) drivable to move transversely to them and operated by said controllable drive (35) to move toward said stationary deflecting rolls (28, 29) and back.

36. The device in accordance with claim 29, wherein said web accumulator (27) is driven by a selected one of electrical and hydraulic and pneumatic means.

37. The device in accordance with claim 29, wherein in addition to said active take-off roll (2), a further roll is provided in a waiting station (3) and, downsteam of said web delivery unit (1), a splicing station (4) where an end (37) of the web of said active take-off roll (2) is placed against a beginning of said roll in said waiting station and is joined thereto, and wherein when splicing is being performed, said web accumulator pays out the stored web into said processing line.

38. The device in accordance with claim 29, wherein during normal operation said web passes without contact through the splicing station (4) disposed in advance of said web accumulator.

39. The device in accordance with claim 37, wherein said web delivery unit (1), a splicing station (4) and a compensation system (19) disposed in advance of said web accumulator are stationary and in that the storage capacity of said web accumulator (27) is at least equal to the product of the predetermined web speed and the time needed, in the case concerned, to splice the web ends (37 and 43).

40. The device in accordance with claim 38, wherein during normal processing operation, said web accumulator stands idle in a defined end position (32).

41. The device in accordance with claim 35, wherein provided in the web path between said web accumulator (27) and said processing line (39) is a device for measuring current tensile load (47).

42. The device in accordance with claim 35, wherein end positions of the movable roll (31) of said web accumulator (27) are analyzed electronically with respect to the current position thereof.

* * * * *